US009335739B2

(12) United States Patent
Gilomen et al.

(10) Patent No.: US 9,335,739 B2
(45) Date of Patent: May 10, 2016

(54) TIMEPIECE ABLE TO INDICATE THE SUNRISE OR SUNSET ANYWHERE IN THE WORLD

(71) Applicant: The Swatch Group Research and Development Ltd, Marin (CH)

(72) Inventors: Beat Gilomen, Grenchen (CH); Michel Willemin, Preles (CH); Dominique Lechot, Reconvilier (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 14/862,382

(22) Filed: Sep. 23, 2015

(65) Prior Publication Data

US 2016/0098012 A1 Apr. 7, 2016

(30) Foreign Application Priority Data

Oct. 7, 2014 (EP) ..... 14187982

(51) Int. Cl.
*G04B 19/26* (2006.01)

(52) U.S. Cl.
CPC ..... *G04B 19/26* (2013.01); *G04B 19/262* (2013.01)

(58) Field of Classification Search
CPC ..... G04B 19/00; G04B 19/26; G04B 19/262; G04B 19/226
USPC ..... 368/16–17
See application file for complete search history.

(56) References Cited

U.S. PATENT DOCUMENTS 4,714,351 A * 12/1987 Domen ..... G09B 27/08 368/17
4,887,250 A * 12/1989 Vuarnesson ..... G04B 19/26 368/15
5,280,458 A * 1/1994 Scott ..... G04B 19/226 368/24
6,834,025 B1 12/2004 Loaiza
7,012,855 B1 * 3/2006 Loaiza ..... G04B 19/226 368/17
9,207,642 B2 * 12/2015 Willemin ..... G04B 19/262
2002/0131329 A1 9/2002 Ochoa Loaiza

FOREIGN PATENT DOCUMENTS

CH 705 722 A1 5/2013
JP 2001-290418 10/2001
WO WO 02/082191 A1 10/2002

OTHER PUBLICATIONS

European Search Report issued Jul. 30, 2015 in European Application 14187982, filed on Oct. 7, 2014 ( with English Translation).

* cited by examiner

*Primary Examiner* — Sean Kayes
(74) *Attorney, Agent, or Firm* — Oblon, McClelland, Maier & Neustadt, L.L.P.

(57) ABSTRACT

The timepiece comprises means for indicating the sunrise and sunset taking account of seasonal variations. These means comprise a sphere reproducing the terrestrial globe, a shell arranged concentrically to the sphere and arranged to demarcate one portion of the terrestrial globe where it is night from another portion where it is day by indicating the position of the Earth's terminator. The shell can pivot about the globe on two axes perpendicular to each other. The shell is driven by the movement so as to rotate at a rate of one revolution per 24 hours about the polar axis. A disconnecting mechanism is controlled by an annual cam which has a profile representative of the tilt of the Sun with respect to the equatorial plane. The disconnecting mechanism controls the tilt of the shell about the axis by means of a drive shaft concentric to the polar axis.

12 Claims, 4 Drawing Sheets

TIMEPIECE ABLE TO INDICATE THE SUNRISE OR SUNSET ANYWHERE IN THE WORLD

This application claims priority from European Patent Application No. 14187982.5 filed on Oct. 7, 2014, the entire disclosure of which is hereby incorporated herein by reference.

FIELD OF THE INVENTION

The present invention relates to a timepiece comprising a timepiece movement and means for indicating the sunrise and sunset taking account of seasonal variations, said means comprising a sphere reproducing the terrestrial globe, a support, and a circle mounted on the support and arranged concentrically to the sphere, the circle being arranged to indicate the position of the Earth's terminator, the circle and the sphere being arranged to be able to pivot with respect to each other along two perpendicular axes, a first of the two axes corresponding to the polar axis of the terrestrial globe, and the second axis intersecting the first axis at the centre of the sphere, the circle being free to rotate with respect to the support about the second axis, the sunrise and sunset indicator means further comprising an annual cam having a profile representative of the tilt of the Sun with respect to the equatorial plane and arranged to be driven in rotation by the movement at the rate of one revolution per year, a cam follower arranged to cooperate with the cam, and a kinematic connection arranged to connect the cam follower to the circle such that the plane subtended by the circle forms, with the first axis, an angle equal to the tilt angle of the Sun with respect to the equatorial plane.

PRIOR ART

The duration of the day is the time comprised, each day, between the moment when the upper limb of the Sun appears above the horizon in the east, at sunrise, until it disappears below the horizon in the west, at sunset. Whatever the time, there is always one half of the surface of the globe which is illuminated by the sun and another half which is in darkness. The Earth's terminator is the line of demarcation between the portion of the Earth which is illuminated and that which is in darkness. Geometrically speaking, the Earth's terminator is a large circle which encircles the terrestrial globe. This large circle extends in a plane perpendicular to the plane of the Earth's orbit around the sun (called the ecliptic plane). It may also be noted that the centre of the Earth is on the line of intersection between these two planes.

Generally, the duration of the day varies throughout the year and depends on latitude. This variation is caused by the tilt of the axis of rotation of the Earth on itself relative to the ecliptic plane. This tilt by definition corresponds to the latitude of the tropics which is ±23° 27'. As is well known, the duration of the day is shortest at the December solstice in the Northern Hemisphere, and at the June solstice in the Southern Hemisphere. At the equinoxes, the duration of day and night are equal everywhere on Earth.

There are already known timepieces corresponding to the definition given in the above preamble. FIG. 3 of the German Utility Model DE7014354 (U), in particular, discloses a table clock comprising a sphere that reproduces the terrestrial globe and which is mounted on a vertical axis to rotate above a case-like support. The upper face of the support has an annular dial arranged concentrically to the axis of the sphere and featuring a 24 hour circle. A timepiece movement housed inside the support is provided for rotating the terrestrial globe above the dial at the rate of one revolution per 24 hours. This known table clock further comprises a hemispherical shell that is slightly larger than the terrestrial globe and mounted concentrically thereto so as to surround the globe and only reveal half of it. The hemispherical shell is arranged to make it possible to distinguish, on the terrestrial globe, between a half sphere illuminated by the Sun and another which is in darkness. The hemispherical shell is also hinged on two vertical posts on either side of the Earth. It can therefore pivot about a horizontal axis which intersects the vertical arbor which carries the globe at the centre thereof. The shell is also fitted with a rack arranged to cooperate with a pinion forming part of a mechanism provided for controlling the tilt angle of the shell so that this angle covers the entire range of values between – and +23.5°, once a year in one direction and then in the other, to reproduce the effect of the variation in the tilt angle of the Sun above the equator according to the seasons.

It will be understood that the table clock described in the aforementioned prior art document reproduces the succession of nights and days on Earth from what might be called a Copernican point of view. Indeed, with this prior art design, it is the Earth which rotates on itself, while the shadow from the Sun simply changes tilt according to the seasons. Although it may be less accurate from a scientific point of view, the geocentric representation whereby we are at the centre, while the Sun rotates about us, accords much more closely with our intuition.

BRIEF SUMMARY OF THE INVENTION

It is an object of the present invention to provide a timepiece allowing the succession of nights and days on Earth to be reproduced in accordance with a geocentric point of view. This object is achieved by providing a timepiece comprising a timepiece movement and an indicator or means for indicating the sunrise and sunset taking account of seasonal variations, said indicator or means comprising a sphere reproducing the terrestrial globe, a support, and a circle mounted on the support and arranged concentrically to the sphere, the circle being arranged to indicate the position of the Earth's terminator, the circle and the sphere being arranged to be able to pivot with respect to each other along two perpendicular axes, a first of the two axes, referred to as the polar axis, corresponding to the polar axis of the terrestrial globe, and the second axis, referred to as the ecliptic axis, intersecting the polar axis at the centre of the sphere, the circle being free to rotate with respect to the support about the ecliptic axis, the sunrise and sunset indicator means further comprising an annual cam having a profile representative of the tilt of the Sun with respect to the equatorial plane and arranged to be driven in rotation by the movement at the rate of one revolution per year, a cam follower arranged to cooperate with the cam, and a kinematic connection arranged to connect the cam follower to the circle such that the plane subtended by the circle forms, with the polar axis, an angle equal to the tilt angle of the Sun with respect to the equatorial plane.

According to the Invention:

- the support is arranged to be driven by the movement so as to rotate at a rate of one revolution per 24 hours about the polar axis while driving the circle;
- the sunrise and sunset indicator means comprise a drive shaft concentric to the polar axis and arranged to be driven in rotation at the same speed as the support, but angularly offset with respect to the support;
- the kinematic connection between the cam follower and the circle comprises a disconnecting mechanism connected to the cam follower and to the drive shaft, and arranged such that the angular offset is representative of the tilt of the Sun with respect to the equatorial plane, the kinematic connection further comprising transmission means arranged such that a change in angular offset results in a corresponding change in the value of the angle between the plane subtended by the circle and the polar axis;

the kinematic connection between the cam follower and the circle is an intermittent connection, the disconnecting mechanism being arranged to periodically readjust the angular offset by forming a transient coupling between the drive shaft and the cam follower.

It will be understood that, according to the invention, the circle representing the Earth's terminator rotates with its support at a rate of one revolution per 24 hours about the polar axis of the terrestrial globe. Further, the circle is mounted to pivot on the rotating support, so that it can also change its tilt with respect to the polar axis. The angle of tilt of the circle is controlled by a drive shaft arranged concentrically to the rotating support. The drive shaft is actuated by the movement to rotate at the same speed as the support, but with a certain phase shift. It is the value of the phase shift that determines the tilt of the circle with respect to the polar axis.

It will be understood that, in the present context, the expression "circle" does not necessarily mean an absolutely complete circle. It may also be a circle which exhibits at least one break. Indeed, according to the invention, the axis about which the circle is mounted to pivot, intersects the polar axis of the terrestrial globe perpendicularly. According to an advantageous embodiment of the invention, the terrestrial globe is mounted on an arbor which extends concentrically to the polar axis. In these conditions, there must be at least one break in the circle to enable the arbor and the circle to intersect when the tilt of the circle with respect to the polar axis passes through zero. Further, according to a preferred variant of this latter embodiment, the arbor that carries the sphere is a through arbor pivoted at both ends. As will be seen below, there must then be two breaks in the circle, disposed opposite each other, on the same diameter perpendicular to the pivot axis of the circle.

According to the invention, an intermittent kinematic connection between the annual cam and the drive shaft allows the phase shift between the arbor and the rotating support to be periodically adjusted. Further, the invention stipulates that readjustment of the phase shift occurs only when the rotating support is clearly defined predetermined angular positions. In these conditions, since the position of the support at the moment of readjustment is known, the phase shift is thus entirely determined by the angular position of the drive shaft. It is thus possible to readjust the phase shift simply by readjusting the angular position of the drive shaft. According to the invention, it becomes possible to readjust the angular position of the drive shaft by establishing a transient coupling between the shaft and the cam follower.

According to a preferred embodiment of the invention, the kinematic connection between the cam follower and the drive shaft passes through a disconnecting mechanism which is arranged to form the transient coupling between the shaft and the cam follower and, concurrently, to disconnect the drive shaft from the movement.

According to a preferred embodiment of the invention, the timepiece is a watch which comprises a dial, the polar axis X-X being oriented parallel to the plane of the dial. This feature is original. Indeed, known timepieces that comprise sunrise and sunset indicator means taking account of seasonal variations, are generally table clocks. In these clocks, the polar axis X-X is normally arranged vertically. Although this arrangement is satisfactory for a table clock, it is not very suitable for a timepiece such as a watch in which the display is only visible from one side through the watch crystal. Indeed, the sphere that reproduces the terrestrial globe must be sufficiently large for it to be easy to identify, at least approximately, any location in the world. The limited space between the dial and the crystal means that the globe used must be compact. To allow a globe of some dimension to be used with a vertically oriented polar axis, the only solution is to provide an opening in the form of a well in the dial to receive the sphere. However, this arrangement limits visibility, since the hemisphere placed underneath is then completely invisible to the watch user. This is the reason why, when the timepiece is a watch comprising a dial, polar axis X-X is preferably oriented parallel to the plane of the dial.

BRIEF DESCRIPTION OF THE FIGURES

Other features and advantages of the invention will appear upon reading the following description, given solely by way of non-limiting example, with reference to the annexed drawings, in which.

DETAILED DESCRIPTION OF ONE EMBODIMENT

Figure 1:
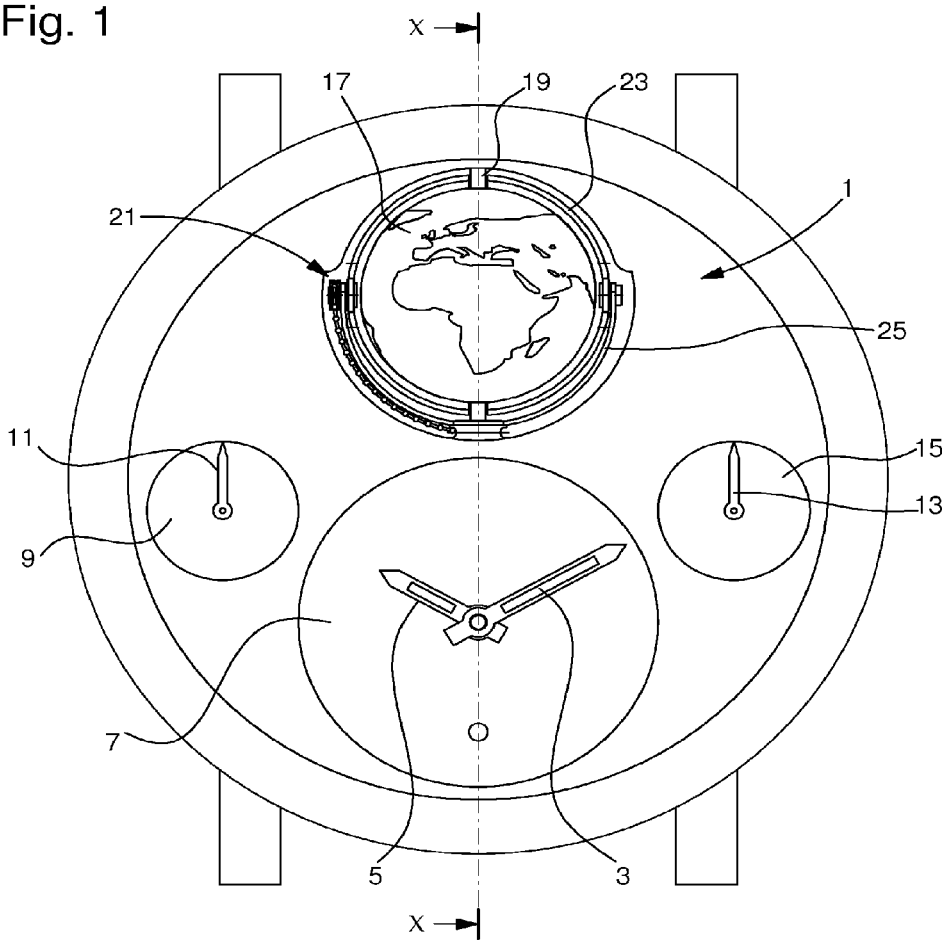
FIG. 1 is a top plan view of a wristwatch according to a particular embodiment of the invention.
Figure 2:
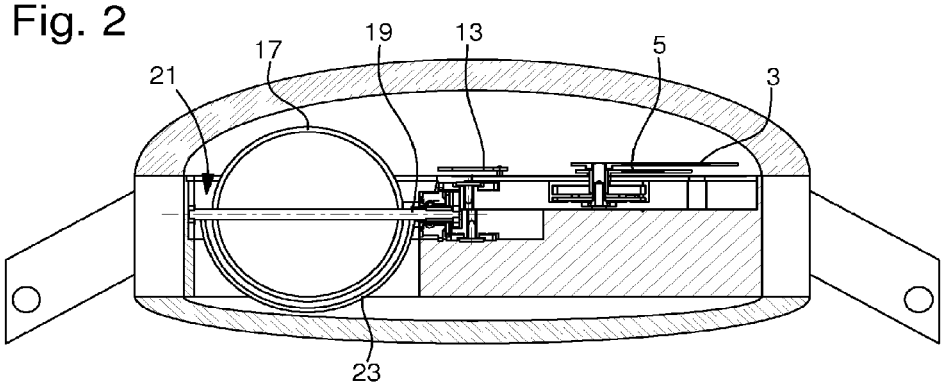
FIG. 2 is a schematic sectional view of the wristwatch of FIG. 1.

The watch illustrated in FIGS. 1 and 2 comprises, in particular, a main dial designated by the general reference numeral 1. The main dial carries three small dials (referenced 7, 9 and 15) to provide the user of the watch with various information. First of all there is the time, which is indicated by two hands 3 and 5, respectively for the minutes and hours, which are arranged to rotate in a conventional manner facing the first small dial 7. The illustrated watch also comprises a calendar whose display uses the two other small dials 9, 15. This calendar will not be described in detail since it is not the subject of the invention. Suffice it to say that the calendar display (from 1 to 31) (or date) is provided by a small hand 13 arranged to rotate above small dial 15, and that another small hand 11 is arranged to provide an indication of the month of the year in cooperation with the third small dial 9.

According to the invention, the watch illustrated also comprises means for indicating the sunrise and sunset at different locations on Earth taking account of seasonal variations. In this regard, the watch of FIGS. 1 and 2 also comprises a sphere 17 which represents the terrestrial globe. It can be seen that sphere 17 is mounted on a through arbor 19 which is arranged concentrically to the polar axis X-X of the terrestrial globe. In the embodiment illustrated, arbor 19 is oriented parallel to the plane of the dial, and its two ends are engaged in two bearings (not referenced) carried by the frame so as to allow the sphere to rotate about polar axis X-X. It is also seen that the sphere is accommodated in a well 21 arranged at 12 o'clock in dial 1. Further, polar axis X-X of the globe is superposed on the 12 o'clock-6 o'clock diameter of the watch. In a conventional manner, the north pole of the globe is oriented upwards (towards 12 o'clock).

According to the invention, the means for indicating the sunrise and sunset at various locations on Earth also comprise a circle 23 mounted on a support 25 and arranged concentrically to sphere 17. In the embodiment shown, it is seen that the sunrise and sunset indicator means comprise, as a circle, a shell 27 of hemispheric shape which is arranged concentrically to sphere 17 so as to conceal half of the terrestrial globe. It will be understood that, according to this particular embodiment, hemispheric shell 27 has a substantially circular edge, and this edge forms circle 23 according to the invention. It is therefore the position of the circular edge of shell 27 that indicates the position of the Earth's terminator. One advantage associated with using a shell in the form of a half-sphere, instead of a simple ring, is that it is possible to distinguish clearly between a part of the terrestrial globe where it is night time from another part where it is daytime. Shell 27 may, for example, be made of a translucent or transparent material which is preferably slightly tinted, to give the impression that the portion of the globe covered by the shell is in darkness. According to another variant (not shown), the shell could have the shape of a sphere formed by joining two half-spheres of different colours, one depicting the day and the other the night. The half sphere depicting the day would thus preferably be more transparent than the other, so as to reveal the surface of the terrestrial globe. It will be understood that according to this latter variant, the two half-spheres form between them a substantially circular joint, and that this joint forms the circle according to the invention. Another advantage of this latter variant is that it makes it possible to represent the Sun in the middle of the half-sphere depicting the day. Thus, this variant can provide a watch that indicates the moment at which the Sun is at its zenith.

Figure 3A:
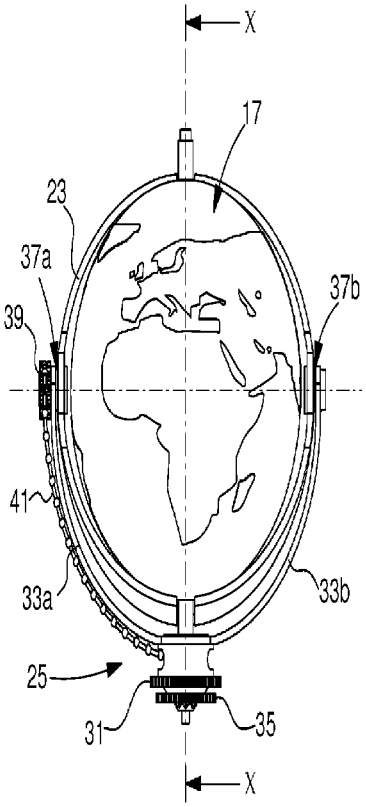
FIGS. 3A, 3B and 3C are partial views of a particular embodiment of the sunrise and sunset indicator means of the invention. The three partial views show the sphere that reproduces the terrestrial globe, the support and a shell that is mounted to pivot on the support and which is arranged concentrically to the sphere. The support is seen in a front view in FIG. 3A, a profile view in FIG. 3B and a three-quarter view in FIG. 3C.
Figure 3B:
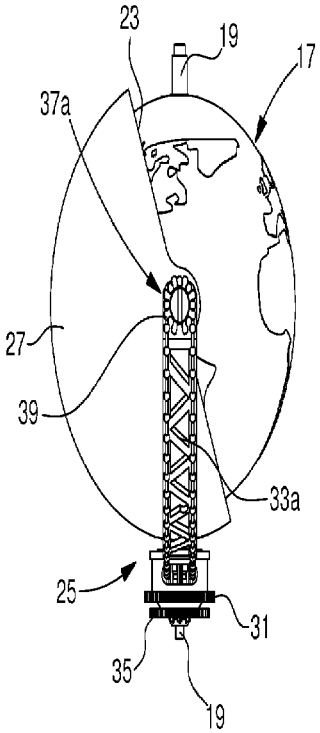
Figure 3C:
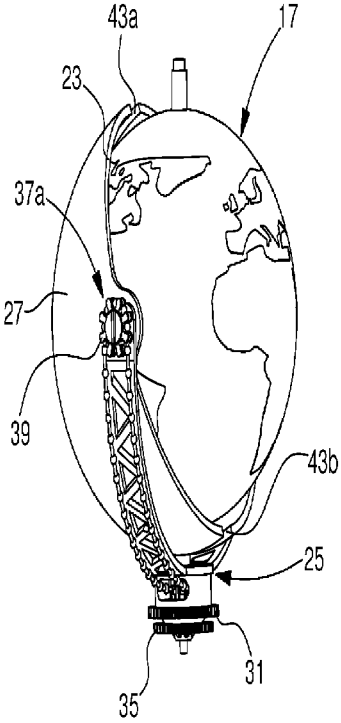
Figure 4:
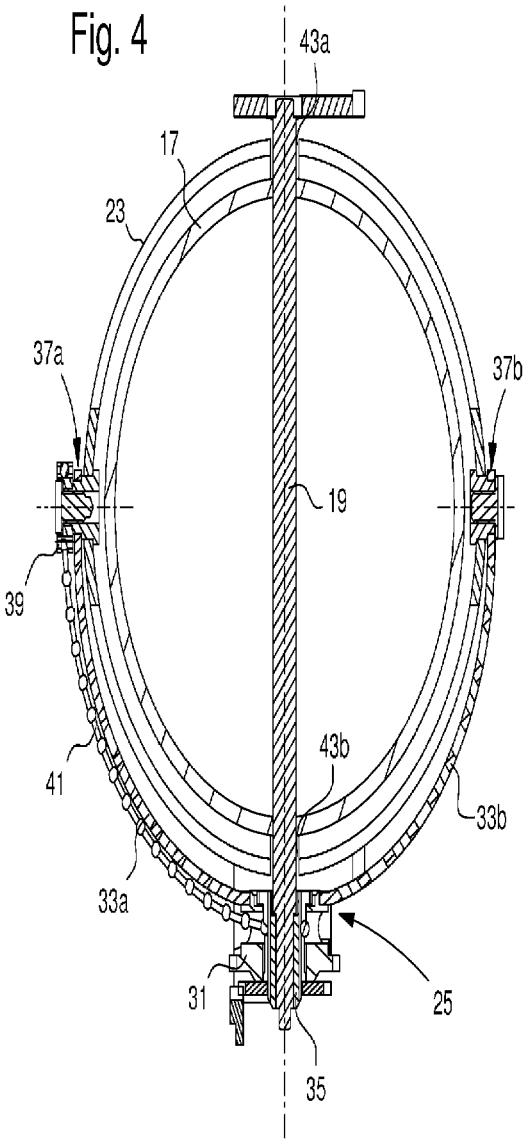
FIG. 4 is a partial cross-sectional view of the sunrise and sunset indicator means of FIGS. 3A, 3B and 3C; the support being seen in a front view as in FIG. 3A.

FIGS. 3A, 3B, 3C and 4 are more detailed views of the assembly formed by the sphere 17, support 25 and shell 27. The three views 3A, 3B and 3C respectively show the shell and the support in front, profile and three-quarter views. FIG. 4 illustrates the same assembly in a cross-sectional front view as in FIG. 3A. Referring still to FIG. 3A, it is seen that support 25 has the general shape of a fork with a short shaft which carries two arms 33*a* and 33*b* that extend symmetrically on either side of the sphere. In the variant shown, support 25 has an axis of symmetry that coincides with polar axis X-X of the terrestrial globe. Referring now to the enlarged cross-section of FIG. 4, it can be seen that the shaft of the support is formed by a first hour-wheel (referenced 31) inside which passes a second hour-wheel 35 in addition to arbor 19. In the illustrated embodiment, the second hour-wheel is inserted between arbor 19 and first hour-wheel 31. It will be understood, however, that according to a variant, it could be the first hour-wheel that is placed inside the second hour-wheel. It will also be understood that, in both variants, the two hour-wheels 31, 35 and arbor 19 are free to rotate independently of each other.

It can also be seen in the Figures that shell 27 is mounted to pivot between the two arms 33*a*, 33*b* by means of two hinges referenced 37*a*, 37*b*, which are arranged coaxially in the extension of each other. The shell can thus pivot on support 25 about an axis of rotation that passes through the two hinges. This axis of rotation, which intersects polar axis X-X at the centre of sphere 17, will be referred to hereafter as the "ecliptic axis" and referenced Y-Y. Each of the two hinges 37*a*, 37*b* is formed by a pivot carried by the edge of shell 27 and which is inserted in a bearing fixed to the end of one of arms 33*a*, 33*b*. It will also be noted that the pivots that are inserted in the two bearings occupy diametrically opposite positions on the large circle 23 formed by the edge of the shell.

Referring again to FIGS. 3A and 4, it can be seen that a chain 41 connects the second hour-wheel 35 to hinge 37*a*. More specifically, chain 41 is stretched between a circular groove in hour-wheel 35 and a pinion (referenced 39) carried by hinge 37*a*. Pinion 39 is fixed to the end of the pivot integral with shell 27. It will be understood that, in the illustrated embodiment, hour-wheel 35 forms the drive shaft according to the invention, and that the circular groove, chain 41 and pinion 39 together form the transmission means arranged to connect the drive shaft to circle 23. According to the arrangement that has just been described, any rotation of hour-wheel 35 with respect to support 25 is transmitted to pinion 39 by chain 41. Thus, any rotation of hour-wheel 35 with respect to support 25 causes a corresponding rotation of shell 27 about ecliptic axis Y-Y. It will be understood that the mechanism that has just been described allows the tilt angle of shell 27 relative to polar axis X-X to cover the entire range of values comprised between + and −23.5°, in one direction and then in the other. It will be understood that, as a result of this arrangement, the sunrise and sunset indicator means are capable of taking account of the effect of variation in the tilt of the Sun above the equator according to the seasons. Referring more particularly to FIGS. 3C and 4, it is observed that the shell edge 23 also has two notches 43*a* and 29*b* arranged in diametrically opposite positions midway between hinges 37*a* and 37*b*. It will be understood that the function of notches 43*a* and 43*b* is to allow the passage of arbor 19 when shell 27 is tilted relative to the polar axis (X-X).

It has been seen that, according to the invention, support 25 is arranged to be driven by the movement so as to rotate at a rate of one revolution per 24 hours about first axis X-X. Further, a drive shaft coaxial with polar axis X-X is arranged to be driven in rotation by the movement by means of a disconnecting mechanism, at the same speed as support 25, but angularly offset with respect to the support. It will be understood that, in the illustrated embodiment, the drive shaft is formed by hour-wheel 35, and that the movement rotates support 25 via the toothing of hour-wheel 31.

Figure 5A:
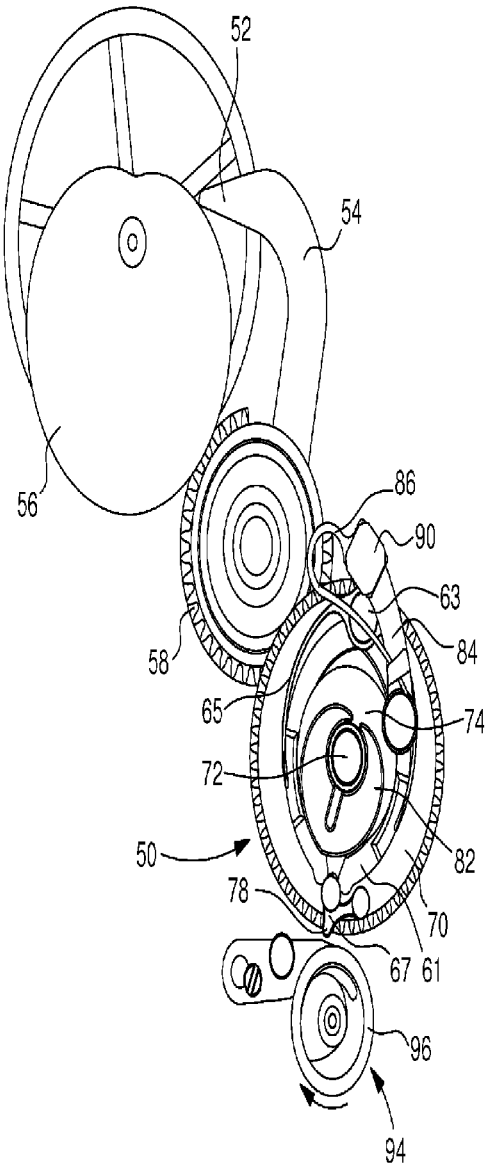
FIGS. 5A and 5B are schematic, partial, respectively top and bottom plan views of the kinematic connection connecting the cam follower to the circle according to an embodiment of the invention. The partial views of FIGS. 5A and 5B more particularly show the disconnecting mechanism.
Figure 5B:
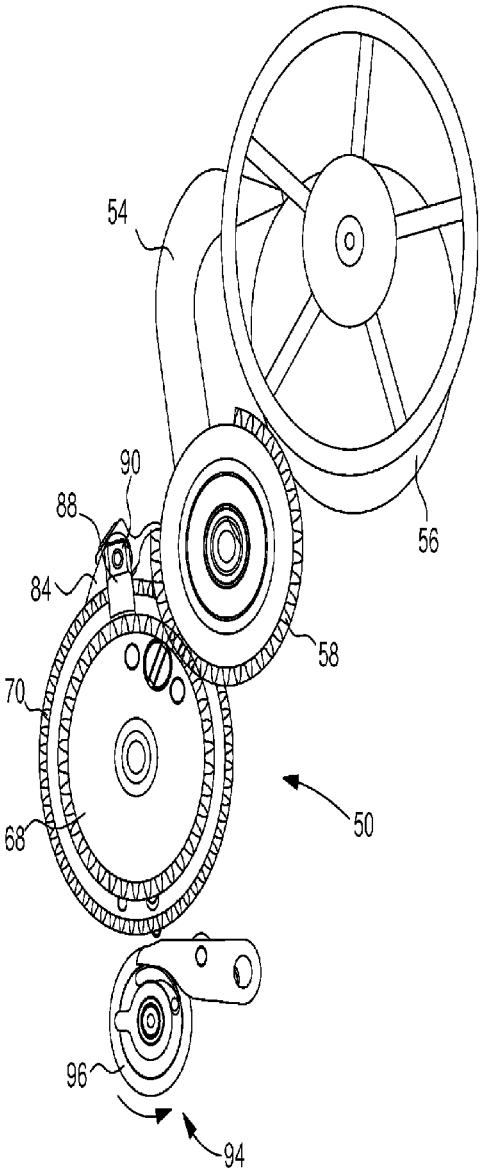

Referring now to FIGS. 5A and 5B, there is shown an annual cam 56 associated with a cam follower 54. Cam 56 is shaped such that its profile is representative of the tilt of the Sun with respect to the Earth's equatorial plane. Cam 56 is arranged to be driven in rotation by the movement at a rate of one revolution per year. Cam follower 54 is arranged to cooperate with the cam. FIGS. 5A and 5B also show a disconnecting mechanism generally referenced 50. According to the invention, disconnecting mechanism 50 is arranged to form a transient coupling between the drive shaft and cam follower 54, so as to permit periodic adjustment of the angular offset between the drive shaft (referenced 35 in FIG. 4, not shown in FIGS. 5A and 5B) and the support (referenced 25 in FIGS. 3 and 4, not shown in FIGS. 5A and 5B). As will be seen hereafter, the interval separating two successive transient couplings must correspond to an integer number of periods of revolution of an input wheel set (referenced 70) of the disconnecting mechanism.

Referring again to FIGS. 5A and 5B, it can be seen that cam follower 54 is formed by a rack comprising a toothed sector 58 and a handle that ends in a feeler-spindle 52. This rack is subjected to the return action of a spring (not shown) which tends to press feeler-spindle 52 against the periphery of annual cam 56. Further, as shown more particularly in FIG. 5B, the toothed sector of the rack is arranged to mesh with a toothed wheel 68 of disconnecting mechanism 50. It will be understood that the angular position of toothed wheel 68 reflects that of the cam follower. It is therefore representative of the tilt of the Sun with respect to the equatorial plane.

Figure 6:
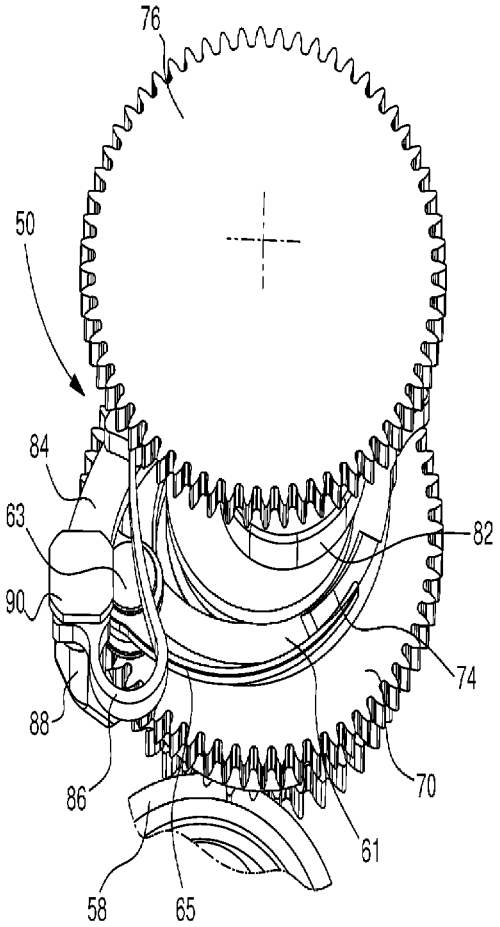
FIG. 6 is a perspective view of the disconnecting mechanism of FIGS. 5A and 5B.

Referring now simultaneously to FIGS. 5A, 5B and 6, it can be seen that disconnecting mechanism 50 comprises a basic wheel set comprising a wheel 70 integral with an arbor 72 (seen in FIG. 5A). It also comprises an output wheel set formed of an hour-wheel 74 and a toothed wheel 76 (shown only in FIG. 6). Wheel 76 is mounted on the pipe of hour-wheel 74. The latter is fitted loosely on arbor 72 of the basic wheel set so as to be free to rotate concentrically to wheel 70.

It is also seen that a locking clamp 61 surrounds hour-wheel 74. This clamp is hinged on a pivot 63 which is fixed in an off-centre position on the plate of the wheel 70 of the basic wheel set. A double spring 65 returns the jaws of the locking clamp against the exterior of hour-wheel 74. Finally, a small T-shaped lever 67 is pivoted at the base of the T on the plate of hour-wheel 70. Small lever 67 is arranged so that a force exerted on a first end 78 of the bar of the T causes the other end to be inserted between the jaws of clamp 61 and to act as a wedge moving said jaws apart. It will be clear that when the jaws of locking clamp 61 are closed, hour-wheel 74 is integral with the basic wheel set which then drives it in rotation. Thus, the output wheel set is integral with the basic wheel set provided no force is exerted on end 78 of the small control lever 67. It will therefore be understood that it is not possible to modify the phase shift between wheel 70 of the basic wheel set and wheel 76 of the output wheel set, while the jaws of clamp 60 are closed around hour-wheel 74.

Disconnecting mechanism 50 further comprises an assembly formed of a heart-piece 82, which is driven onto the pipe of hour-wheel 74 and a correction lever 84, the end of which is returned against the periphery of the heart-piece by a spring 86. Moreover, as can be seen in FIG. 5B, a radial arm referenced 88 is fixed to toothed wheel 68. Arm 88 extends first of all radially to beyond the toothing of wheel 70 and then curve upwards and ends approximately opposite heart-piece 82. The end of arm 88 forms a small off-centre support 90 and it will be clear that the function of toothed wheel 68 with its arm 88 is that of a rotating frame. FIG. 6 also shows that small support 90 is used both as a point of anchorage for spring 86 and as a pivot point for correction lever 84. Finally, it is seen that correction lever 84 carries at the end thereof a roller, and that the roller is pressed against the periphery of heart-piece 82 by spring 86. In a known manner, the force exerted by the roller on the heart-piece has a tangential component which tends to return the heart-piece in the direction of its stable angular position of equilibrium, or, in other words, towards the position where the roller is in the heart-piece notch.

FIGS. 5A and 5B also show an instantaneous actuator (generally referenced 94). The instantaneous actuator is controlled by the movement and arranged to actuate the disconnecting mechanism 50 by abruptly repulsing the first end 78 of the bar of the T of the small T-shaped lever 67. Instantaneous actuator 94 is already known. Indeed, the instantaneous actuator illustrated in FIGS. 5A and 5B is described in Patent Publication EP 2 503 407 entitled "Timepiece movement comprising an instantaneous actuator controlled by the movement". This prior art document is incorporated herein by reference.

Instantaneous actuator 94 comprises a dragging wheel 96 driven in rotation about its axis by the movement. It will be understood that the speed of rotation of wheel 96 determines the frequency at which the instantaneous actuator actuates the disconnecting mechanism. One advantage resulting from the use of an instantaneous actuator rather than a simple finger carried by a dragging wheel, is that the instantaneous actuator makes it possible to determine the precise moment at which small lever 67 is pushed back, and the moment at which it is released. Indeed, the duration of the period during which the actuator pushes back the T-shaped lever is not determined by the rotational speed of the dragging wheel, but by a much quicker double detent mechanism.

The operation of the disconnecting mechanism forming the subject of the present example will now be described. In the illustrated example, basic wheel set 70 performs the function of the input wheel set of the disconnecting mechanism. It is driven by the movement at the speed of one revolution every 12 hours. According to the above explanation, provided no force is exerted on control lever 67, hour-wheel 74 and heart-piece 72 are integrally connected to wheel 70 of the basic wheel set. The basic wheel set therefore drives them in rotation at the rate of two revolutions per 24 hours. As explained above, instantaneous actuator 94 is arranged to press on the end 78 of small lever 67 once every 12 hours. It will be noted, however, that according to the invention, the interval between two actuations is not necessarily equal to the period of rotation of the input wheel set of the disconnecting mechanism. Indeed, according to other embodiments, the interval between two actuations could correspond to any integer multiple of the period of revolution of the basic wheel set.

Each time that it presses on small lever 67, the instantaneous actuator forces the jaws of locking clamp 61 to open partially and release their pressure on hour-wheel 74, so that the output wheel set is briefly disconnected from the basic wheel set. The hour-wheel is then free to pivot under the action of correction lever 84 and its spring 86. Hour-wheel 74 then pivots until the correction lever roller is immobilised in the notch of heart-piece 82. It will be understood that the angular position of the output wheel set at the moment when the lever is immobilised in the heart-piece notch depends on the angular position of the small off-centre support 90 that carries correction lever 84. Since the small off-centre support is fixed to toothed wheel 68 and the latter meshes with cam follower 54, the angular position of the heart-piece is ultimately determined by the angular position of annual cam 56.

A few moments after releasing the output wheel set, the instantaneous actuator stops pressing on control lever 67 and the jaws of clamp 61 close on hour-wheel 74 again, thus fixing the phase shift between the basic wheel set and the output wheel set for the next 12 hours. In this regard, it will be clear that the phase shift between the two wheel sets at the moment when clamp 61 closes on hour-wheel 74 again is determined, on the one hand, by the angular position of annual cam 56 and on the other hand, by the angular position of wheel 70 of the basic wheel set at that moment. The angular position of wheel 70 at the moment when the locking means close again, is thus critical for the operation of the disconnecting mechanism of the present invention. This is why the interval between two releases of the disconnecting mechanism must correspond to a multiple integer of the period of revolution of the basic wheel set.

The output wheel set of disconnecting mechanism 50 is arranged to drive the drive shaft by means of a gear train. Let us recall that, in the present example, the output wheel set of the disconnecting mechanism is formed by hour-wheel 74 and toothed wheel 76 which is mounted on the hour-wheel pipe, and that the second hour-wheel 35 forms the drive shaft according to the invention. A gear train (not shown in the Figures) is also provided for connecting toothed wheel 76 to second hour-wheel 35. This gear train may be made in any manner known to those skilled in the art. It is worth noting, however, that toothed wheel 76 normally completes one revolution in 12 hours, whereas the second hour-wheel 35 is arranged to complete one revolution in 24 hours. The gear train must therefore be a reduction gear train with a gear ratio equal to ½. Further, according to the illustrated embodiment, the polar axis (X-X) is oriented parallel to the dial. In these conditions, it will be understood in particular that the first and second hour-wheels 31, 35 are arranged lying down. As a result, second hour-wheel 35 and output wheel 76 of the disconnecting mechanism are perpendicular. It is therefore possible to provide a conical gear in the aforementioned gear train to permit the connection between toothed wheel 76 and second hour-wheel 35.

What is claimed is:

1. A timepiece comprising a timepiece movement and means for indicating the sunrise and sunset taking account of seasonal variations, said means comprising a sphere reproducing the terrestrial globe, a support, and a circle mounted on the support and arranged concentrically to the sphere, the circle being arranged to indicate the position of the Earth's terminator, the circle and the sphere being arranged to be able to pivot with respect to each other along two perpendicular axes, a first of the two axes, referred to as the polar axis, corresponding to the polar axis of the terrestrial globe, and the second axis, referred to as the ecliptic axis, intersecting the polar axis at the centre of the sphere, the circle being free to rotate with respect to the support about the ecliptic axis, the sunrise and sunset indicator means further comprising an annual cam having a profile representative of the tilt of the Sun with respect to the equatorial plane and arranged to be driven in rotation by the movement at the rate of one revolution per year, a cam follower arranged to cooperate with the cam, and a kinematic connection arranged to connect the cam follower to the circle such that the plane subtended by the circle forms, with the polar axis, an angle equal to the tilt angle of the Sun with respect to the equatorial plane, wherein:

the support is arranged to be driven by the movement so as to rotate at a rate of one revolution per 24 hours about the polar axis while driving the circle;

the sunrise and sunset indicator means comprise a drive shaft concentric to the polar axis and arranged to be driven in rotation at the same speed as the support, but angularly offset with respect to the support;

the kinematic connection between the cam follower and the circle comprises a disconnecting mechanism connected to the cam follower and to the drive shaft, and arranged such that the angular offset is representative of the tilt of the Sun with respect to the equatorial plane, the kinematic connection further comprising transmission means arranged such that a change in angular offset results in a corresponding change in the value of the angle between the plane subtended by the circle and the polar axis;

the kinematic connection between the cam follower and the circle is an intermittent connection, the disconnecting mechanism being arranged to periodically readjust the angular offset by forming a transient coupling between the drive shaft and the cam follower.

2. The timepiece comprising sunrise and sunset indicator means according to claim 1, wherein the disconnecting mechanism is arranged to form the transient coupling between the drive shaft and the cam follower, and concurrently to disconnect the drive shaft from the movement.

3. The timepiece comprising sunrise and sunset indicator means according to claim 1, wherein the timepiece comprises a dial, the polar axis being oriented parallel to the plane of the dial, and wherein the ecliptic axis is comprised in a plane perpendicular to the polar axis and which corresponds to the equatorial plane of the terrestrial globe.

4. The timepiece comprising sunrise and sunset indicator means according to claim 1, wherein the timepiece is a watch.

5. The timepiece comprising sunrise and sunset indicator means according to claim 1, wherein the sunrise and sunset indicator means taking account of seasonal variations comprise a shell arranged concentrically to the sphere reproducing the terrestrial globe, the shell being arranged to demarcate one portion of the terrestrial globe where it is night from another portion where it is day, and wherein the shell has the general shape of a half-sphere and has an edge of generally circular shape, the edge forming the circle arranged to indicate the position of the Earth's terminator.

6. The timepiece comprising sunrise and sunset indicator means according to claim 5, wherein the ecliptic axis is substantially collinear with a diameter of the circle, and wherein the shell carries two pivots extending the two ends of the diameter, the two pivots being respectively pivoted on first and second arms of the support.

7. The timepiece comprising sunrise and sunset indicator means according to claim 6, wherein the edge of the shell has two notches arranged in diametrically opposite positions midway between the two pivots.

8. The timepiece comprising sunrise and sunset indicator means according to claim 6, wherein the first and second arms of the support are pierced to increase the part of the surface of the terrestrial globe visible at a given time.

9. The timepiece comprising sunrise and sunset indicator means according to claim 6, wherein the first and second arms of the support are made of a transparent material to increase the part of the surface of the terrestrial globe visible at a given time.

10. The timepiece comprising sunrise and sunset indicator means according to claim 1, wherein the timepiece comprises a calendar mechanism arranged to indicate the date and the month, and wherein the annual cam is kinematically connected to the calendar mechanism.

11. The timepiece comprising sunrise and sunset indicator means according to claim 1, wherein the circle is kinematically connected to the drive shaft by a belt or a chain.

12. The timepiece comprising sunrise and sunset indicator means according to claim 1, wherein the kinematic connection comprises a lever, one end of which forms the cam follower and the other end of which carries a rack meshing directly with an input of the disconnecting mechanism.

* * * * *